US005340157A

United States Patent [19]

Perelman

[11] Patent Number: 5,340,157

[45] Date of Patent: Aug. 23, 1994

[54] BUSINESS FORM ADAPTED FOR FACSIMILE TRANSMISSION

[76] Inventor: David Perelman, 8214 Marion Rd., Elkins Park, Pa. 19117

[21] Appl. No.: 926,858

[22] Filed: Aug. 6, 1992

[51] Int. Cl.[5] ..... B42D 15/00

[52] U.S. Cl. ..... 283/62; 283/101; 283/115; 283/117

[58] Field of Search ..... 283/62, 115, 116, 117, 283/81, 63.1, 101, 105

[56] References Cited

U.S. PATENT DOCUMENTS

| | | | |
|---|---|---|---|
| 3,074,392 | 1/1963 | Fisher | 125/20 |
| 4,559,705 | 12/1985 | Hodge et al. | 283/115 X |
| 5,085,469 | 2/1992 | Castro | 283/101 X |

FOREIGN PATENT DOCUMENTS

| | | |
|---|---|---|
| 2115539 | 7/1972 | France . |
| 981502 | 1/1965 | United Kingdom . |

*Primary Examiner*—Paul A. Bell
*Attorney, Agent, or Firm*—Weiser & Associates

[57] ABSTRACT

A business form which is configured to cooperate with conventional facsimile machines to minimize the amount of time required to transmit a document includes vertical lines which are broken to extend only partially along the document, rather than extending continuously along the document as was previously conventional. Such discontinuous lines leave open spaces which can take advantage of the ability of a conventional facsimile machine to operate at a faster rate for blank (open) areas than the rate which is normally encountered for "populated" (marked) areas of the document, reducing the overall transmission rate for a given document.

9 Claims, 3 Drawing Sheets

BUSINESS FORM ADAPTED FOR FACSIMILE TRANSMISSION

BACKGROUND OF THE INVENTION

The present invention generally relates to business forms such as accounting paper and the like, and in particular, to business forms which are particularly well suited to transmission using conventional facsimile machines.

Since its inception, the facsimile machine has been taking an ever-increasing role in the transmission of documents, both locally and over long distances. This capability has been harnessed by virtually every business endeavor, primarily due to the enhanced rate at which information may be transferred from location to location. One such field of endeavor, where the transmission of up-to-date information is often critical, is that of accounting and business record-keeping. In this field, the transmission of information by facsimile is rapidly becoming the norm, rather than the exception.

While the need for the facsimile transmission of information is ever-increasing, such transmissions do present certain limitations. For example, the transmission of documents by facsimile machine, even using state of the art equipment, is relatively expensive and time consuming. The transmission of even a single sheet of paper may take up to one minute or possibly one and one-half minutes to accomplish (depending upon the format of the data). This can become severely limiting when large numbers of documents need to be transmitted, as is often the case when transmitting accounting, or other business information. In connection with an average accounting report, a complete transmission of the document may take up to twenty minutes or more to complete. The foregoing is not only time consuming, but also rather labor intensive (since an operator must generally be present) and expensive (to cover the associated telephone line charges and to purchase and maintain the facsimile machine). Nevertheless, because of the need for a rapid exchange of information, these disadvantages are simply tolerated.

SUMMARY OF THE INVENTION

Accordingly, it is a primary object of the present invention to provide a means for transmitting documents by facsimile machine both more efficiently and at an enhanced rate.

It is also an object of the present invention to provide means for enhancing the facsimile transmission of documents which can provide improved results irrespective of the facsimile machine, including both differences in the type of facsimile machine which is being used as well as future enhancements to existing facsimile machines.

It is also an object of the present invention to provide means for enhancing the facsimile transmission of documents without in any way compromising the content of the information which is to be transmitted.

It is also an object of the present invention to provide means for enhancing the transmission of documents by facsimile machine which is cost effective and easy to use.

In accordance with the present invention, these and other objects which will become apparent are achieved by providing a business form which is configured to cooperate with conventional facsimile machines to minimize the amount of time required to transmit a document. To this end, vertical lines associated with the business form are broken to extend only partially along the document, rather than extending continuously along the document as was previously conventional. Such discontinuous lines leave open spaces which can take advantage of the ability of a conventional facsimile machine to operate at a faster rate for blank (open) areas than the rate which is normally encountered for "populated" (marked) areas of the document. As a result, the overall transmission rate for a given document is significantly reduced, with corresponding reductions in cost.

In a particularly preferred embodiment, such improvements are applied to conventional accounting paper to provide a "fax-ready" accounting paper which exhibits all of the conveniences of conventional accounting paper, but which incorporates partial vertical lining to enhance its ability to be transmitted by facsimile machine. To this end, the normally continuous vertical lines of a conventional sheet of accounting paper are replaced with either partial vertical lines, or possibly a "dot matrix" which can even further enhance the rate of facsimile transmission.

For further detail regarding preferred business forms produced in accordance with the present invention, reference is made to the detailed description which is provided below, taken in conjunction with the following illustrations.

BRIEF DESCRIPTION OF THE DRAWINGS

In the several views which are provided, like reference numbers denote similar structures.

DETAILED DESCRIPTION OF PREFERRED EMBODIMENTS

Figure 1:
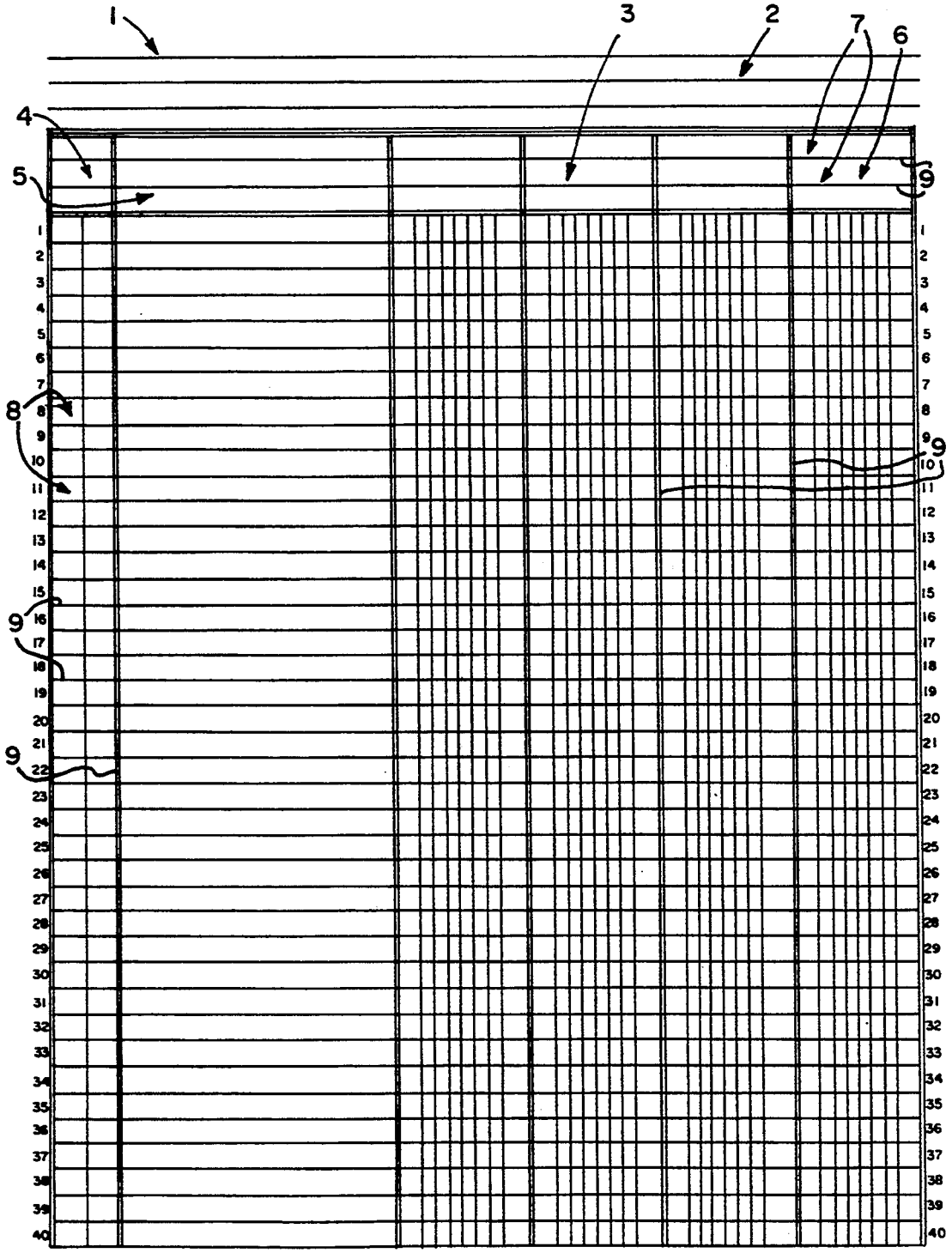
FIG. 1 is a plan view of a conventional sheet of accounting paper, as is presently in common use.

FIG. 1 is a plan view of a conventional sheet 1 of "accounting paper", as is presently commonly used in the accounting profession. An information block 2 is provided at the top of the page, to receive appropriate account-identifying information and the like. The remainder of the sheet 1 is comprised of a data-containing portion 3, which is itself subdivided into a series of columns 4, 5, 6 and plural rows 7, 8. A first column 4 is often used to receive the date of given entry, while a second column 5 is often used to receive a description for the entry which is then placed in the data receiving columns 6 which follow. Upper rows 7 of the sheet 1 are often used to receive column headings and the like, while remaining rows 8 are used to receive the data which is to be placed on the form.

It is important to note that in many cases, not all of the columns 4, 5, 6, or all of the rows 7, 8, will be fully utilized. Rather, blank columns and rows will often be present. This is evident from the exemplary data which is shown on the sheet 1 of FIG. 1, which is shown for illustrative purposes only. It should also be noted that while the sheet 1 incorporates numerous blank spaces, the indicia (lines 9) which separate the sheet 1 into the several columns 4, 5, 6 and rows 7, 8 are continuous, progressing fully along and across the sheet 1.

However, it is this very aspect of the sheet 1 of accounting paper which is limiting to facsimile transmission. Conventional facsimile machines read a document line by line. If any markings are present on a given line, that line is read at a set rate which is established for data transmission, even if there is no actual data on that line (e.g., a "blank" line with vertical markings 9). It is only if no markings are present on the line that the facsimile machine will operate to, in essence, ignore a line which is completely blank, and advance the paper at an increased rate. Resulting from this, even though a data-containing rows 7, 8 may be blank, the facsimile machine will nevertheless detect the vertical lines 9 and, as a result, proceed at the slower, data transmitting rate.

Figure 2:
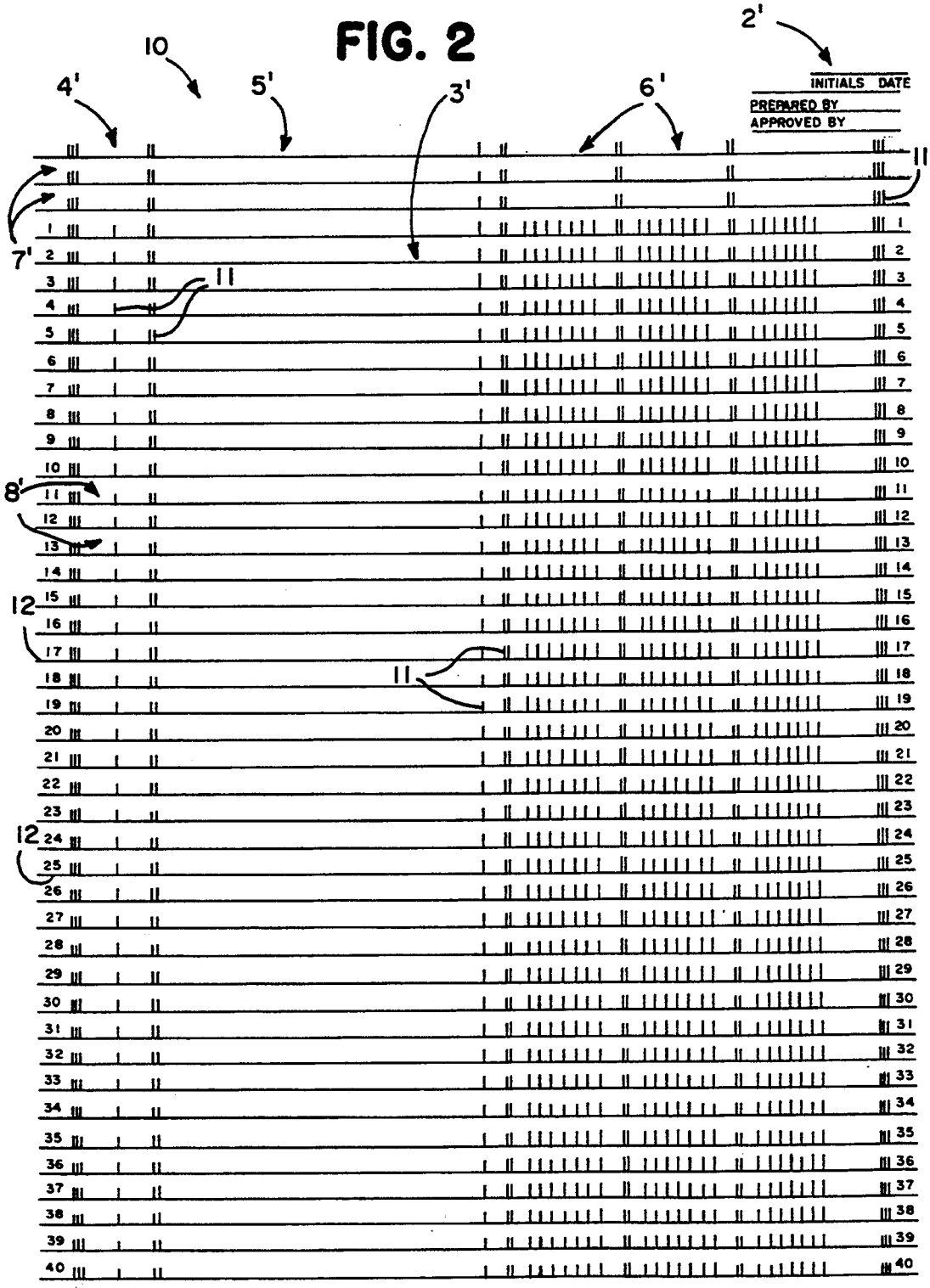
FIG. 2 is a plan view of a sheet of accounting paper incorporating partial vertical lining in accordance with the present invention.

In accordance with the present invention, and referring now to FIG. 2 of the drawings, the sheet 10 of accounting paper has indicia (lines) which are broken, and therefore better suited to conventional facsimile machines in order to take advantage of the enhanced rate at which facsimile transmissions may be accomplished for open (blank) areas of a given sheet of paper. To this end, the sheet 10 is again provided with an information block 2' and a data-containing portion 3' which is separated into a series of columns 4', 5', 6' and rows 7', 8'. However, the lines 11 forming the columns 4', 5', 6' are now truncated, rather than proceeding continuously along the sheet 10.

The truncated lines 11 extend in a direction which is to correspond to the longitudinal feed path for the sheet 10 when the sheet 10 is introduced into a conventional facsimile machine. In the illustrative case of FIG. 2, the truncated lines 11 extend vertically, and the sheet 10 will be longitudinally fed into the facsimile machine (with a shorter side leading or trailing). The lines 12 forming the rows 7', 8' are in this case fully continuous, extending transversely across the sheet 10. However, this does not compromise the rate at which the sheet 10 may be fed through a facsimile machine since lines generally perpendicular to the direction of paper feed will be read at the same rate, whether continuous or not. Nevertheless, it is also possible to form discontinuous lines 12 across the sheet 10, if desired. One such use for this would be to permit the sheet 10 to be fed either longitudinally or transversely, through the facsimile machine.

In any event, the sheet 10 is able to receive and convey the same information as a conventional sheet 1 since the same basic indicia (columns and rows) are present in both cases, and in substantially similar configurations. Thus, use of the sheet 10 is in all material ways identical to use of the sheet 1 so that the practitioner is in no way limited. However, significant improvements result when transmitting the sheet 10 by facsimile machine. The reason for this is that unlike the sheet 1, as the sheet 10 is fed through the facsimile machine, significant blank areas will be present between rows 7', 8' of the sheet 10 which are not provided with data. These blank areas will pass through the facsimile machine at an increased rate since there is no data to be read, and since there are no markings to otherwise limit the facsimile machine to its data transmission rate. It has been found that in use, a single sheet 10 will generally take only 60 to 70% of the amount of time necessary to transmit a single sheet 1 bearing similar information. Corresponding savings are shown in transmitting plural sheets 10. As a result, there is a significant reduction in the amount of time necessary to transmit a series of documents (reducing the amount of time needed to attend to the facsimile machine, and the line charges associated with a desired transmission).

In the illustrative embodiment of FIG. 2, the sheet 10 incorporates truncated lines 11 which progress approximately half way between adjacent (row-marking) lines 12. This leaves approximately one-half of the row blank, for transmission at an increased data rate. It has been found that this still leaves sufficient delineation between respective markings to permit the sheet 10 to be employed in conventional fashion, and without a change in working habits. However, if desired, the lines 11 may be truncated to a greater or lesser extent, as desired. Extension of the lines 11 will result in a somewhat slower rate of data transmission. However, the sheet of paper will have a more conventional overall appearance. Shortening the lines 11 will result in a somewhat increased rate of data transmission. However, the sheet of paper will then have a somewhat less conventional overall appearance. The length selected for the lines 11 is therefore dependent upon the transmission rate which is desired, and the degree of convenience (conventional appearance) which is to be provided in using the sheet of paper.

Figure 3:
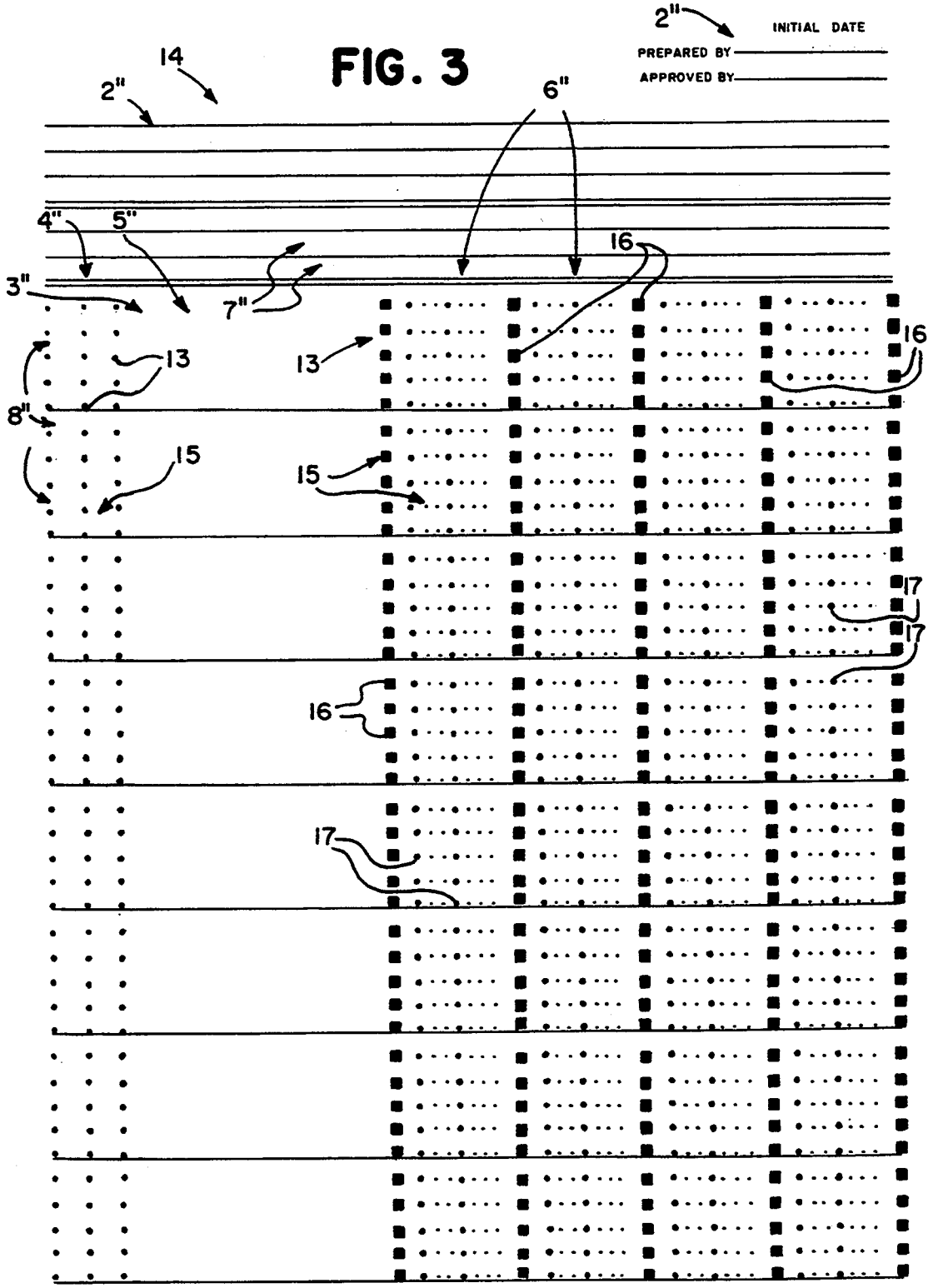
FIG. 3 is a plan view of a sheet of accounting paper incorporating alternative embodiment markings produced in accordance with the present invention.

For example, referring now to FIG. 3 of the drawings, it is possible to reduce the lines 11 of the sheet 10 to point markings 13. In such case, the resulting sheet 14 is virtually devoid of vertical markings, leaving only some of the horizontal markings (the point markings 13) for reference purposes. Thus, columnar data is delineated by a series of ellipses 15, rather than by a series of lines 9 (of a conventional sheet 1), or even a series of truncated lines 11 (of a sheet 10 produced in accordance with the present invention). If desired, the ellipses 15 may take the form of a series of point markings separating the sheet 14 into desired columns. However, for ease in use, it is preferable to provide different ellipses 15 representative of different columnar markings. For example, in the illustrative embodiment shown, a series of squares 16 are used to separate columns, while a series of bullets 17 (enlarged dots) are used to represent commas (to separate thousands) and conventional decimal points are used to separate numbers (dollars and cents). In any event, a clear indication of data receiving columns is provided for use in otherwise conventional fashion. However, elimination of the vertical lines 9, 11 permits the sheet 14 to be transmitted by a facsimile machine at a significantly enhanced rate since significant blank spaces will be encountered (for unused areas on the sheet 14) between adjacent "rows" 7'', 8'' of the sheet 14. Nevertheless, data is easily entered into the "columns" 4'', 5'', 6'' which are defined by the ellipses 15, permitting straightforward use of the sheet 14 in otherwise conventional fashion.

It will therefore be understood that various changes in the details, materials and arrangement of parts which have been herein described and illustrated in order to explain the nature of this invention may be made by those skilled in the art within the principle and scope of the invention as expressed in the following claims. It will further be understood that while the improvements of the present invention have been described in conjunction with sheets of accounting paper, such improvements will apply equally to other types of business forms, or other types of documents which are to be transmitted by a facsimile machine.

What is claimed is:

1. A business form which comprises an opaque sheet having indicia for separating the sheet into plural data-receiving portions, for transmission by a conventional facsimile machine having a direction of feed for receiving the sheet and for directing the sheet through the facsimile machine, wherein the business form includes indicia extending in a first direction substantially parallel to the direction of feed through the conventional facsimile machine, and wherein the indicia extending in the first direction are truncated in the first direction, leaving blank regions extending fully across the business form in a second direction substantially perpendicular to the first direction, whereby the business form is capable of being fed into the facsimile machine for transmission at an increased rate.

2. The business form of claim 1 wherein the sheet has a length, and a width of a size less than the length, and wherein the first direction is substantially parallel to the length of the sheet and the second direction is substantially parallel to the width of the sheet.

3. The business form of claim 1 wherein the business form includes indicia forming rows extending across the business form, in the second direction, wherein the indicia extending in the first direction extend no more than half way between adjacent row-forming indicia.

4. The business form of claim 3 wherein the row-forming indicia are truncated, leaving blank regions extending fully along the business form in the first direction.

5. The business form of claim 3 wherein the indicia extending in the first direction are point markings.

6. The business form of claim 5 wherein the point markings define blank regions extending fully across the business form in the second direction, and blank regions extending fully along the business form in the first direction.

7. The business form of claim 5 wherein different point markings define different regions on the business form.

8. The business form of claim 7 wherein a plurality of squares separate adjacent columns of the business form.

9. The business form of claim 8 which a plurality of ellipses define separate regions within the columns.

* * * * *